US010703618B2

(12) United States Patent
Ziesel

(10) Patent No.: US 10,703,618 B2
(45) Date of Patent: Jul. 7, 2020

(54) MICRO-INGREDIENT BASED BEVERAGE DISPENSER

(71) Applicant: The Coca-Cola Company, Atlanta, GA (US)

(72) Inventor: Lawrence B. Ziesel, Woodstock, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 15/776,453

(22) PCT Filed: Nov. 15, 2016

(86) PCT No.: PCT/US2016/062030
§ 371 (c)(1),
(2) Date: May 16, 2018

(87) PCT Pub. No.: WO2017/087383
PCT Pub. Date: May 26, 2017

(65) Prior Publication Data

US 2018/0327245 A1 Nov. 15, 2018

Related U.S. Application Data

(60) Provisional application No. 62/256,271, filed on Nov. 17, 2015.

(51) Int. Cl.
*B67D 1/00* (2006.01)
*B67D 1/08* (2006.01)
(Continued)

(52) U.S. Cl.
CPC ..... *B67D 1/0022* (2013.01); *B67D 1/00* (2013.01); *B67D 1/0044* (2013.01);
(Continued)

(58) Field of Classification Search
CPC .. B67D 1/0022; B67D 1/0036; B67D 1/0037; B67D 1/0038; B67D 1/0039;
(Continued)

(56) References Cited

U.S. PATENT DOCUMENTS 3,592,367 A * 7/1971 Landis ..... B67D 1/0051 222/244
4,392,588 A * 7/1983 Scalera ..... G07F 13/10 222/129.4
(Continued)

FOREIGN PATENT DOCUMENTS

WO 2007127525 A2 11/2007
WO 2014036098 A1 3/2014
(Continued)

OTHER PUBLICATIONS

International Search Report and Written Opinion, PCT/US2016/062030, dated Feb. 15, 2017 (13 pp.).
(Continued)

*Primary Examiner* — Paul R Durand
*Assistant Examiner* — Robert K Nichols, II
(74) *Attorney, Agent, or Firm* — Eversheds Sutherland (US) LLP

(57) ABSTRACT

Technologies are described herein for a dispensing nozzle for a beverage dispensing system. An example embodiment of the dispensing nozzle may include a housing; a nozzle manifold containing orifices and corresponding conduits for a number of diluents, macro-ingredient sweeteners, and micro-ingredients; a sweetener channel and a diluent baffle, the combination of which facilitates the mixing of the diluent and macro-ingredient sweetener; a funnel; and a nozzle exit. The diluent, macro-ingredient sweetener, and micro-ingredients may mix in the dispensing nozzle to form a predetermined beverage. The dispensing nozzle may communicate with various aspects of the beverage dispensing system to coordinate the dispensing of the predetermined beverage.

14 Claims, 6 Drawing Sheets

(51) Int. Cl.
*B67D 1/10* (2006.01)
*B67D 1/07* (2006.01)

(52) U.S. Cl.
CPC ..... *B67D 1/0048* (2013.01); *B67D 1/0078* (2013.01); *B67D 1/0085* (2013.01); *B67D 1/07* (2013.01); *B67D 1/08* (2013.01); *B67D 1/0888* (2013.01); *B67D 1/10* (2013.01); *B67D 2210/00146* (2013.01)

(58) Field of Classification Search
CPC ..... B67D 1/0044; B67D 1/0048; A45D 2200/0058; B65D 83/682; B05B 7/0408
USPC ..... 222/129.3, 145.5
See application file for complete search history.

(56) References Cited

U.S. PATENT DOCUMENTS 4,753,370 A * 6/1988 Rudick ..... B67D 1/0051 222/105
5,685,639 A * 11/1997 Green ..... B01F 13/0227 366/101
7,108,156 B2 * 9/2006 Fox ..... B67D 1/0021 222/129.1
7,578,415 B2 8/2009 Ziesel et al.
7,757,896 B2 * 7/2010 Carpenter ..... B67D 1/0051 222/129.4
2006/0027598 A1 2/2006 Ubidia et al.
2006/0138170 A1 6/2006 Brim et al.
2009/0120958 A1 5/2009 Landers et al.
2009/0230149 A1 9/2009 Smeller et al.
2011/0024455 A1 2/2011 Bethuy et al.
2012/0228328 A1 * 9/2012 Ryan ..... B01F 7/00216 222/129.4
2014/0263416 A1 9/2014 Green

FOREIGN PATENT DOCUMENTS

WO 2014160346 A1 10/2014
WO 2015082917 A2 6/2015

OTHER PUBLICATIONS

Extended European Search Report, 16866946.3—1018/3377439
PCT/US2016/062030, Jun. 19, 2019 (7 pp.).

* cited by examiner

MICRO-INGREDIENT BASED BEVERAGE DISPENSER

BACKGROUND

Beverage dispensing systems generally contain, among other things, a nozzle for the dispensing and/or mixing of ingredients. The nozzle may be connected to one or more supplies of the ingredients, with a system for transporting the ingredients to the nozzle. Conventional beverage dispensing systems may have separate nozzles for each beverage, with each nozzle connected to a supply of syrup corresponding to a particular beverage. Beverage dispensing systems may also have a single nozzle configured to dispense multiple types of beverages containing a number of different ingredients.

The nozzle may be located above a designated position where a user could position a beverage container, allowing the user to receive a beverage upon activating the beverage dispensing system. The user may activate the beverage dispensing system to receive a beverage containing one or more diluents, macro-ingredient sweeteners, and micro-ingredients.

When the same nozzle is used to dispense multiple types of beverages containing different ingredients, the possibility of cross-contamination of ingredients between beverages exists. Beverage dispensing systems may also have an ice-dispenser chute contained within the nozzle, which creates the possibility of beverage ingredients contaminating the ice-dispenser chute.

SUMMARY

The dispensing nozzle discussed herein facilitates the dispensing of a beverage. As described herein, various aspects of the device and dispensing system are provided. As further described herein, the dispensing nozzle may comprise a housing forming a funnel at the bottom. As further described herein, the housing may envelop a nozzle manifold, which contains orifices and conduits for diluents, macro-ingredient sweeteners, and micro-ingredients, which may mix before exiting the dispensing nozzle. As further described herein, an ice dispenser may be located exterior to the nozzle. As further described herein, the components may be modular.

According to one example, a dispensing nozzle comprises a nozzle manifold comprising at least a first orifice and corresponding conduit configured to receive one or more diluents, at least a second orifice and corresponding conduit configured to receive one or more macro-ingredient sweeteners, and a plurality of micro-ingredient orifices and corresponding conduits configured to receive a plurality of micro-ingredients. The dispensing nozzle further comprises the plurality of micro-ingredient orifices and corresponding conduits forming a micro-ingredient conduit system, wherein a center portion of the nozzle manifold includes the micro-ingredient conduit system.

In some embodiments, the first orifice is configured to receive at least carbonated water, and the second orifice is configured to receive at least a nutritive sweetener.

In some embodiments, the nozzle manifold is further comprised of a sweetener channel configured to receive the one or more macro-ingredient sweeteners, the sweetener channel containing a plurality of holes in a bottom surface allowing the one or more macro-ingredient sweeteners to pass through. The nozzle manifold is further comprised of a diluent baffle configured to receive the one or more diluents and the one or more macro-ingredient sweeteners and allow the received diluent and macro-ingredient sweetener to mix.

In some embodiments, the nozzle manifold is further comprised of a sweetener channel configured to receive the one or more macro-ingredient sweeteners, the sweetener channel containing a plurality of holes in a bottom surface allowing the one or more macro-ingredient sweeteners to pass through. The nozzle manifold is further comprised of a diluent baffle configured to receive the one or more diluents and the one or more macro-ingredient sweeteners and allow the received diluent and macro-ingredient sweetener to mix.

In some embodiments, the sweetener channel contains a valve membrane configured to prevent flow of the one or more macro-ingredient sweeteners unless a threshold pressure level is reached.

In some embodiments, the second orifice and corresponding conduit contains a stop valve configured to control the flow of macro-ingredient sweetener.

In some embodiments, the dispensing nozzle is modular.

In some embodiments, the dispensing nozzle is further configured to receive a diluent to wash away one or more residual ingredients from the funnel.

In some embodiments, the dispensing nozzle further comprises a nozzle housing, wherein a bottom portion of the nozzle housing constitutes a funnel having a nozzle exit. The funnel is configured to receive the one or more diluents and the one or more macro-ingredient sweeteners and allow the received diluent and macro-ingredient sweetener to flow down the funnel. The funnel is further configured to allow the received diluent, the received macro-ingredient sweetener, and the received micro-ingredients to mix about the nozzle exit.

According to another example, a beverage dispensing system, comprises a user interface configured to receive a beverage selection, a controller in communication with the user interface, and a dispensing nozzle. The dispensing nozzle comprises a nozzle manifold comprising at least a first orifice and corresponding conduit configured to receive one or more diluents, at least a second orifice and corresponding conduit configured to receive one or more macro-ingredient sweeteners, and a plurality of micro-ingredient orifices and corresponding conduits configured to receive a plurality of micro-ingredients. The plurality of micro-ingredient orifices and corresponding conduits forming a micro-ingredient conduit system, wherein a center portion of the nozzle manifold includes the micro-ingredient conduit system. The beverage dispensing system further comprises a plurality of beverage ingredients in communication with the nozzle and one or more pumps in communication with the controller, wherein the one or more pumps regulate the flow of the plurality of beverage ingredients.

In some embodiments, the beverage dispensing system further comprises an ice dispenser externally disposed to the dispensing nozzle. The ice dispenser and the dispensing nozzle are configured to dispense simultaneously into a beverage container.

In some embodiments, the first orifice is configured to receive at least carbonated water and the second orifice is configured to receive at least a nutritive sweetener.

In some embodiments, the nozzle manifold is further comprised of a sweetener channel configured to receive the macro-ingredient sweetener, the sweetener channel containing a plurality of holes in a bottom surface allowing the macro-ingredient sweetener to pass through. The nozzle manifold is further comprised of a diluent baffle configured to receive the diluent and the macro-ingredient sweetener and allow the received diluent and macro-ingredient sweetener to mix.

In some embodiments, the nozzle manifold is further comprised of a sweetener channel configured to receive the macro-ingredient sweetener, the sweetener channel containing a plurality of holes in a bottom surface allowing the macro-ingredient sweetener to pass through. The nozzle manifold is further comprised of a diluent baffle configured to receive the diluent and the macro-ingredient sweetener and allow the received diluent and macro-ingredient sweetener to mix.

In some embodiments, the sweetener channel contains a valve membrane configured to prevent flow of the macro-ingredient sweetener unless a threshold pressure level is reached.

In some embodiments, the second orifice and corresponding conduit contains a stop valve configured to control the flow of macro-ingredient sweetener.

In some embodiments, the dispensing nozzle is modular.

In some embodiments, the dispensing nozzle is further configured to receive a diluent to wash away one or more residual ingredients from the funnel.

In some embodiments, the beverage dispensing system further comprises a nozzle housing, wherein a bottom portion of the nozzle housing constitutes a funnel having a nozzle exit. The funnel is configured to receive the one or more diluents and the one or more macro-ingredient sweeteners and allow the received diluent and macro-ingredient sweetener to flow down the funnel. The funnel is further configured to allow the received diluent, the received macro-ingredient sweetener, and the received micro-ingredients to mix about the nozzle exit.

The above-described subject matter may also be implemented in other ways. Although the technologies presented herein are primarily disclosed in the context of dispensing beverages, the concepts and technologies disclosed herein are also applicable in other forms. Other variations and implementations may also be applicable. These and various other features will be apparent from a reading of the following Detailed Description and a review of the associated drawings.

This Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Figure 1:
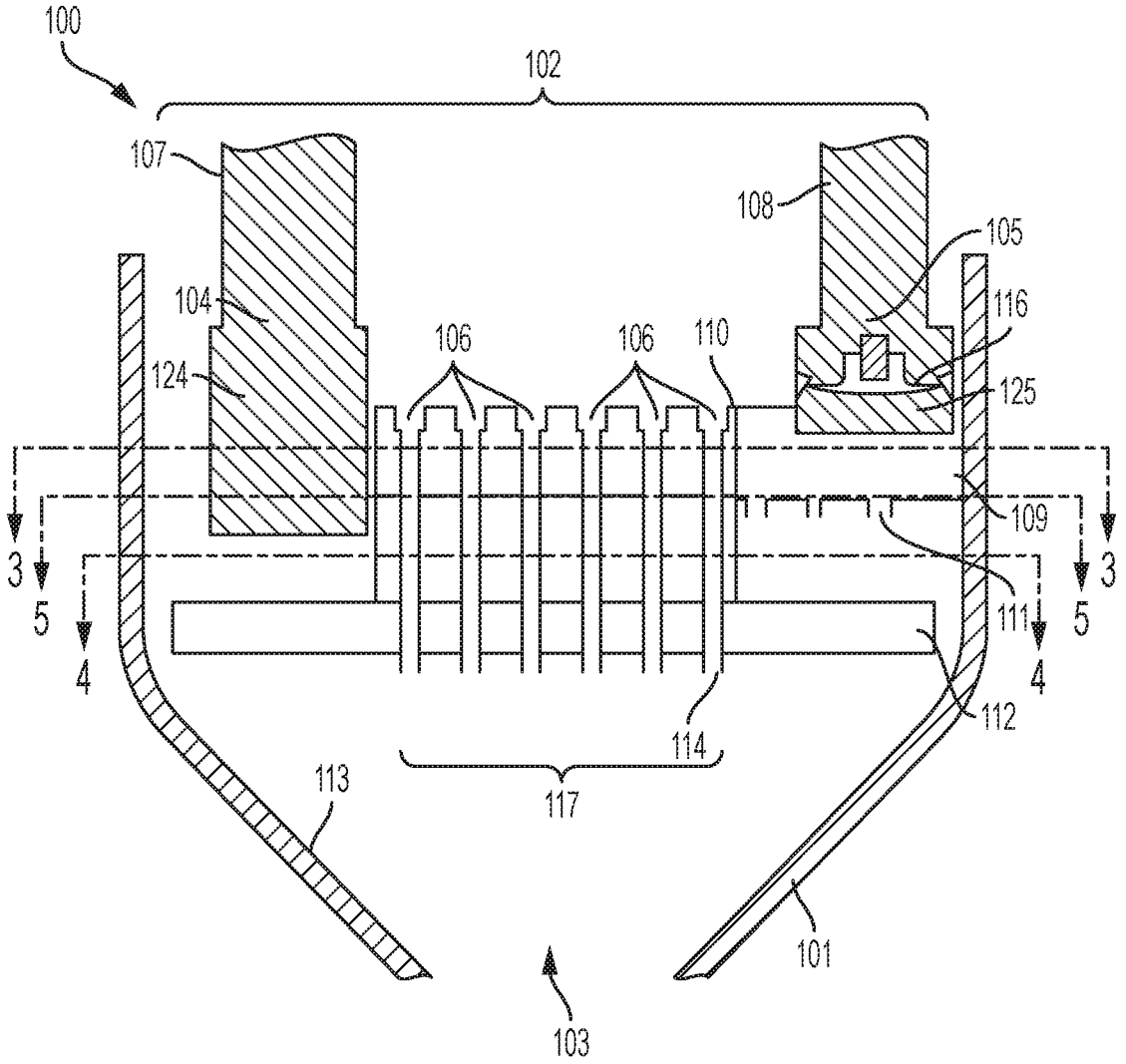
FIG. 1 is a cross-sectional side view of a dispensing nozzle assembly, according to one embodiment presented herein.

The following detailed description is directed to a dispensing nozzle for dispensing beverages, such as Coca-Cola® soft drinks, non-carbonated Coca-Cola® beverages, or the like.

In one aspect, the nozzle may have a nozzle housing with a diameter larger at the top than at the bottom, containing a funnel leading to a nozzle exit at the bottom of the housing, and enveloping a nozzle manifold. The nozzle manifold may have separate orifices and corresponding conduits for each ingredient of a beverage, including orifices and corresponding conduits for diluent, macro-ingredient sweetener, and any micro-ingredients. The micro-ingredient orifices and corresponding conduits may comprise a micro-ingredient conduit system and may be located towards the center of the nozzle manifold. The diluent orifice and corresponding conduit may be located near the outside edge of the nozzle manifold. The sweetener orifice and corresponding conduit may also be located near the outside of the nozzle manifold, opposite the diluent orifice. Each ingredient may be transported to the nozzle manifold and connected to the corresponding orifice through piping, tubing, or some other delivery conduit.

When a beverage calls for a macro-ingredient sweetener, the macro-ingredient sweetener may travel through the sweetener orifice in the top of the nozzle manifold and into the sweetener channel via the sweetener conduit. The macro-ingredient sweetener may include sweetened concentrate, sugar syrup, HFCS syrup, juice concentrate, or other types of nutritive sweeteners. The macro-ingredient sweeteners may have reconstitution ratios typically in the range of about 3:1 to about 6:1 and viscosities in the range of about 100 centipoise or higher. The sweetener channel may be annular, with an inner wall separating the flow of macro-ingredient sweetener from the micro-ingredient conduit system, and with a top and bottom surface, which extend outward from the inner wall to the nozzle housing. The bottom surface may contain sweetener holes such that, as the macro-ingredient sweetener travels in an annular path around the bottom surface, macro-ingredient sweetener flows down through the sweetener holes.

The diluent, which could be carbonated or non-carbonated water or another diluent depending on the beverage, may enter the nozzle manifold through the diluent orifice. The diluent orifice may have a sealed diluent conduit which transports the diluent through the sweetener channel before depositing the diluent above a diluent baffle. The diluent baffle may connect to the inner wall, which separates the flow of diluent from the micro-ingredient conduit system. The diluent baffle may extend outward, leaving a gap between the edge of the diluent baffle and the nozzle housing. After the diluent gets deposited onto the diluent baffle, it may travel in a substantially annular path, allowing it to mix with the macro-ingredient sweetener falling from the sweetener holes above the diluent baffle. The diluent and macro-ingredient sweetener may flow over the edge of the diluent baffle, traveling down a funnel towards the nozzle exit.

When a beverage calls for micro-ingredients, the micro-ingredients may enter the corresponding orifice at the top of the nozzle manifold. Each micro-ingredient may travel vertically downward through a corresponding conduit of uniform diameter, which may transport each micro-ingredient through the nozzle manifold. Different conduits may have different diameters. The micro-ingredients may then be deposited towards the nozzle exit. The flow of the diluent and macro-ingredient sweetener down the funnel creates a mixing action with the micro-ingredients about the nozzle exit, which allows the beverage to mix before and/or after exiting the nozzle.

The micro-ingredient may have a dilution or reconstitution ratio ranging from about ten to one (10:1), twenty to one (20:1), thirty to one (30:1), or higher. Specifically, many micro-ingredients may be in the range of fifty to one (50:1) to three hundred to one (300:1) or higher. The viscosities of the micro-ingredients typically range from about 1 to about 100 centipoise or so. Examples of micro-ingredients include natural and artificial flavors; flavor additives; natural and artificial colors; artificial sweeteners (high potency or otherwise); additives for controlling tartness, e.g., citric acid, potassium citrate; functional additives such as vitamins, minerals, herbal extracts; nutraceuticals; and over-the-counter (or otherwise) medicines such as acetaminophen and similar types of materials. As described above, the acid and non-acid components of the non-sweetened concentrate also may be separated and stored individually. The micro-ingredients may be liquid, powder (solid), or gaseous form and/or combinations thereof. The micro-ingredients may or may not require refrigeration. Non-beverage substances such as paints, dyes, oils, cosmetics, etc., also may be used. Various types of alcohols may be used as micro-ingredients or macro-ingredients.

This invention provides the benefits of reducing cross-contamination, which can occur when ingredients from a first beverage are not fully flushed from the nozzle when a second beverage is dispensed. Moving the micro-ingredients to the middle of the nozzle reduces their contact with the funnel, thereby reducing the need to flush the funnel of micro-ingredients, which are generally more difficult to flush than diluent and macro-ingredient sweetener, before, during, and/or after the dispensing of a beverage.

While the subject matter described herein is presented in the general context of beverage-dispensing nozzle with micro-ingredient orifices, those skilled in the art will recognize that other implementations may be performed in combination with other types of beverage-dispensing nozzles. Generally, beverage-dispensing nozzles include a housing, separate orifices for the ingredients, conduits for transporting the ingredients through the nozzle, a funnel, one or more areas for the ingredients to mix, and parts that perform particular tasks in dispensing a beverage. Moreover, those skilled in the art will appreciate that the subject matter described herein may be practiced with other beverage-dispensing systems.

In the following detailed description, references are made to the accompanying drawings that form a part hereof, and which are shown by way of illustration as specific implementations or examples. Referring now to the drawings, aspects of a beverage-dispensing nozzle will be described in detail.

FIG. 1 illustrates a cross-sectional side view of the dispensing nozzle 100, according to one embodiment of the invention. The dispensing nozzle has a housing 101 that envelops the nozzle manifold 102. The housing 101 is open on top and bottom, and has a non-uniform radius throughout, with the radius of the housing being smaller on bottom than on top. The bottom of the housing forms a funnel 113 and a nozzle exit 103, which is the point at which a beverage exits the dispensing nozzle 100.

The nozzle manifold 102 contains orifices for each ingredient of the beverage, including the diluent orifice 104, the sweetener orifice 105, and micro-ingredient orifices 106. The diluent orifice 104 may be used for water, which may be both carbonated and non-carbonated, other types of diluents, or other fluids. The sweetener orifice 105 may be used for macro-ingredient sweeteners including sweetened concentrate, sugar syrup, HFCS syrup, juice concentrate, or other types of nutritive sweeteners. The micro-ingredient orifices 106 may be used for micro-ingredient acids, micro-ingredient non-acid flavors, and micro-ingredient sweeteners.

The diluent may be delivered to the diluent orifice 104 and corresponding diluent conduit 124 through a diluent delivery conduit 107, which may connect to the diluent orifice 104 by compressing around the diluent orifice 104 or, alternatively, screwing into the diluent orifice 104 via threads, locking into the diluent orifice via slots, or in another manner recognized by a person having ordinary skill in the art. The macro-ingredient sweetener may be delivered to the sweetener orifice 105 and corresponding sweetener conduit 125 through a sweetener delivery conduit 108, which may connect to the sweetener orifice 105 in a manner similar to the connection between the diluent orifice 104 and the diluent conduit 107. The micro-ingredients may be delivered to the corresponding micro-ingredient orifice 106 through micro-ingredient delivery conduits (not pictured), which may be connected in a manner similar to the connection between the diluent orifice 104 and the diluent conduit 107. Alternatively, the micro-ingredient delivery conduits (not pictured) may connect to a disc (not pictured) or like structure with orifices that match up with and connect to the corresponding micro-ingredient orifices 106 when mounted onto the nozzle manifold 102. The disc may screw into the inner wall 110 via threads, lock into the inner wall 110 via slots, or connect in another manner recognized by a person having ordinary skill in the art.

Beneath the top of the nozzle manifold 102 lies the sweetener channel 109. The sweetener conduit 125 may penetrate the top of the sweetener channel 109, allowing the macro-ingredient sweetener to flow into the sweetener channel 109. The diluent conduit 124 may extend through the sweetener channel 109 so as to not mix the diluent with the macro-ingredient sweetener in the sweetener channel 109. In some embodiments, a portion of the diluent may be diverted to the sweetener channel 109 so as to flush the sweetener channel 109 and prevent dripping after a dispense. The sweetener channel 109 may be annular, with an inner wall 110 separating the flow of the macro-ingredient sweetener from the flow of the micro-ingredients. The sweetener channel 109 may extend outward to the edge of the inner wall of the housing 109 or, alternatively, may contain an outer wall. Distributed around a bottom surface of the sweetener channel 109 are sweetener holes 111, which allow the macro-ingredient sweetener to exit the sweetener channel 109. The bottom surface of the sweetener channel 109 may contain a valve membrane 115, such as a liquid-molded silicone or another like material, with a pattern of slits about each of the sweetener holes 111 that may prevent macro-ingredient sweetener from flowing through the sweetener holes 111 unless the sweetener channel 109 is pressurized. Other membranes or valve configurations may be used. The sweetener conduit 125 may contain a stop valve 116, which may prevent the flow of macro-ingredient sweetener when macro-ingredient sweetener is not being pumped through the sweetener orifice 105. In some embodiments, the sweetener conduit 125 may not include the stop valve 116.

Below the sweetener channel 109 may lie a diluent baffle 112. The diluent baffle 112 may be annular, with the inner wall 110 extending at least to the top surface of the diluent baffle 112 to isolate the flow of micro-ingredients from the flow of diluent and macro-ingredient sweetener. The diluent baffle 112 extends outward towards the housing 101, leaving a gap for fluid to flow between the diluent baffle 112 and the inner wall of the housing 101. The diluent exits the diluent conduit 124 at a point above the diluent baffle 112 and contacts the top surface of the diluent baffle 112, causing the diluent to flow in a substantially annular path around the inner wall 110. As the macro-ingredient sweetener exits the sweetener holes 111 above, the macro-ingredient sweetener and diluent mix and flow over the side of the diluent baffle 112 along the funnel 113 towards the nozzle exit 103.

The micro-ingredients may flow through the micro-ingredient conduit system 117, which is located within the inner wall 110. Each micro-ingredient orifice 106 may have a corresponding micro-ingredient conduit 114, which may extend—vertically or otherwise—through the nozzle module 102 to a point at or below the level of the bottle of the diluent baffle 112. Each micro-ingredient conduit 114 may have a uniform diameter throughout. A person having ordinary skill in the art will recognize that the diameter of the micro-ingredient conduits 114 may be varied to achieve the correct flow rate for each micro-ingredient. Each micro-ingredient may exit through the bottom of the micro-ingredient conduit 114 and fall toward the nozzle exit 103. The flow of the diluent and macro-ingredient sweetener down the funnel 113 may create a mixing action with the micro-ingredients around the nozzle exit 103, which may allow the beverage to mix before and/or after exiting the nozzle 100. The micro-ingredients may fall in such a way to avoid contact with the funnel 113, which may reduce the risk of cross-contamination of ingredients between beverages. Having the micro-ingredients fall in this way may also reduce the time needed for a flush cycle, which may consist of dispensing only diluent to wash away residual ingredients on the funnel.

Figure 2:
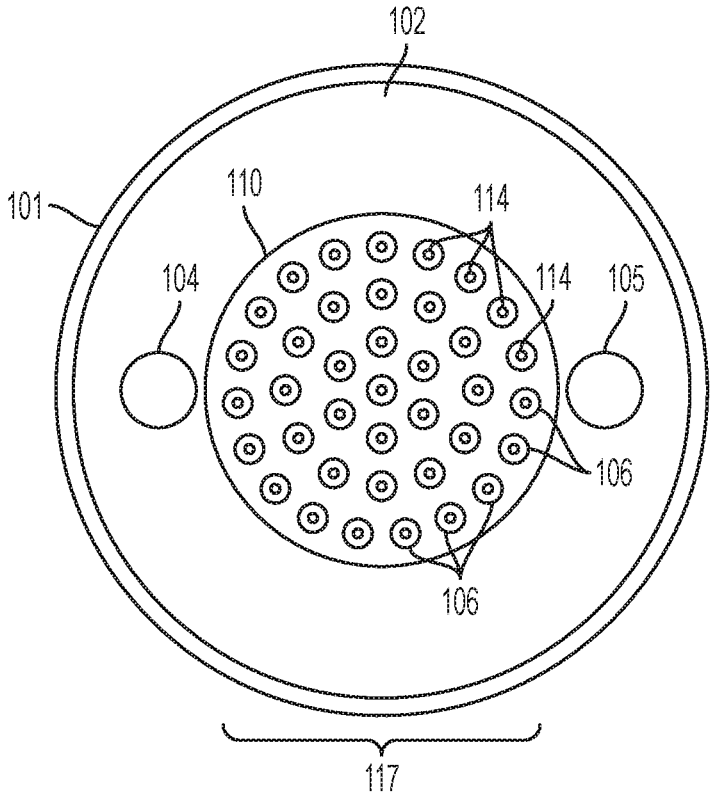
FIG. 2 is a top plan view of the dispensing nozzle assembly according to the embodiment in FIG. 1.

FIG. 2 is a top plan view of the dispensing nozzle 100 according to one embodiment presented herein, which illustrates the top of the nozzle manifold 102. A number of micro-ingredient orifices 106 may be located in the micro-ingredient conduit system 117, which may have a circular cross-section. The number of micro-ingredient orifices 106 may vary depending upon the number of micro-ingredients needed to dispense the desired combination of beverages. Each micro-ingredient orifice 106 has its own micro-ingredient conduit 114, which may extend through micro-ingredient conduit system 117 in the center of the nozzle manifold 102, as shown in FIG. 1. The diluent orifice 104 and the sweetener orifice 105 are located opposite each other between the inner wall 110 and the housing 101.

Figure 3:
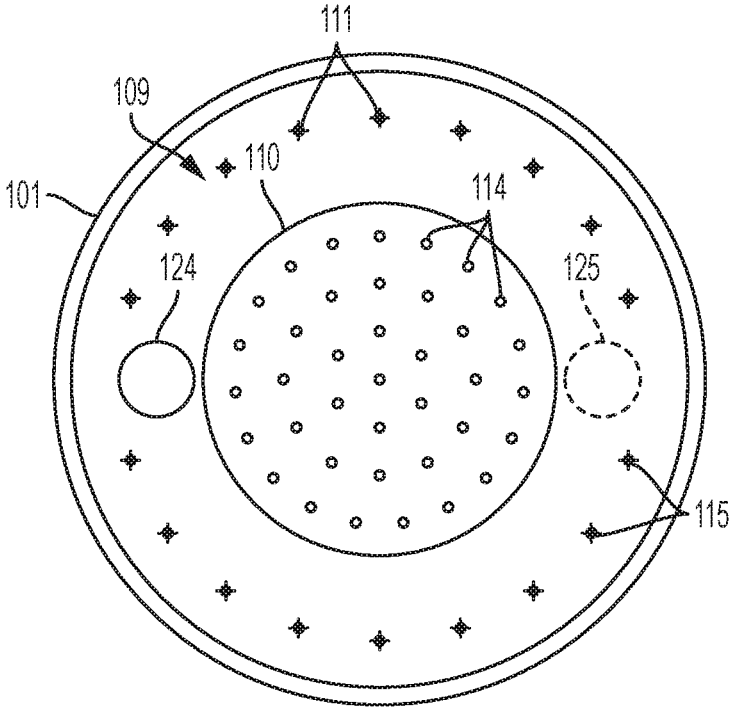
FIG. 3 is a top cross-sectional view of the dispensing nozzle assembly according to the embodiment in FIG. 1 taken along line 3-3 in FIG. 1.

FIG. 3 is a cross-sectional top view of the embodiment in FIG. 1 taken along line 3-3 in FIG. 1 according to one embodiment presented herein, which illustrates the sweetener channel 109. The sweetener channel 109 is annular and forms around the inner wall 110. The micro-ingredients flow through the corresponding micro-ingredient conduits 114, not interacting with the macro-ingredient sweetener in the sweetener channel 109. The sweetener conduit 125 stops above the bottom of the sweetener channel 109, depositing the macro-ingredient sweetener into the sweetener channel 109. The sweetener holes 111 may be distributed around the bottom surface of the sweetener channel 109 so that the macro-ingredient sweetener exits vertically downward through the sweetener holes 111 toward the diluent baffle 112, as shown in FIG. 1. Eighteen sweetener holes 111 are depicted in FIG. 3, but a person having ordinary skill in the art may add or subtract sweetener holes 111 as needed, as well as alter the diameter of the sweetener holes 111 to achieve the correct flow rate of macro-ingredient sweetener. The diluent conduit 124 extends through the sweetener channel 109 so that the diluent and macro-ingredient sweetener do not mix in the sweetener channel 109. The bottom surface of the sweetener channel 109 may contain a valve membrane 115, such as a liquid-molded silicone or another like material, with a pattern of slits about each of the sweetener holes 111 that may prevent macro-ingredient sweetener from flowing through the sweetener holes 111 unless the sweetener channel 109 is pressurized. Other membranes or valve configurations may be used. The valve membrane 115 may also prevent any diluent from traveling vertically upward from the diluent baffle 112 in FIG. 1 through the sweetener holes 111. The sweetener stop valve 116, depicted in FIG. 1, may prevent the flow of macro-ingredient sweetener when macro-ingredient sweetener is not being pumped through the sweetener orifice 105. In some embodiments, the sweetener conduit 125 may not include the stop valve 116. The valve membrane 115 and the sweetener stop valve 116, either separately or in combination, may reduce cross-contamination between beverages.

Figure 4:
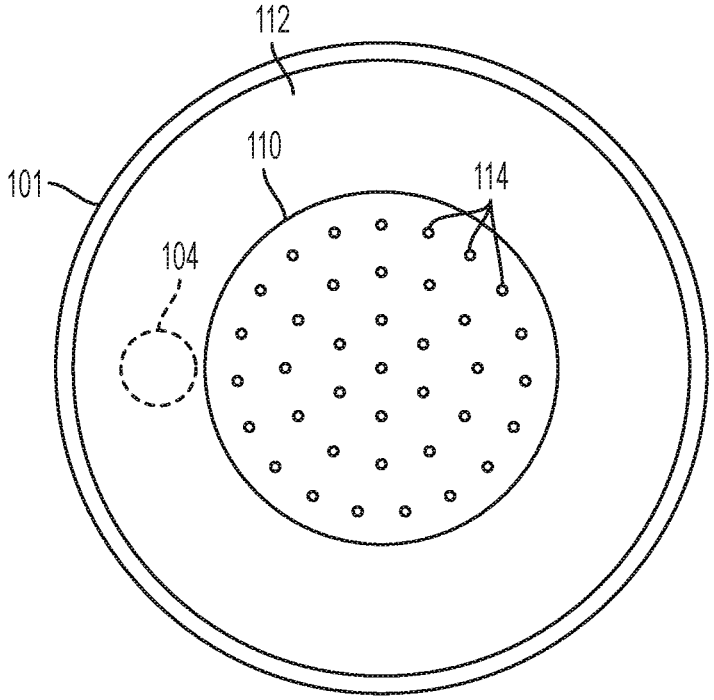
FIG. 4 is a top cross-sectional view of the dispensing nozzle assembly according to the embodiment in FIG. 1 taken along line 4-4 in FIG. 1.

FIG. 4 is a cross-sectional top view of the embodiment in FIG. 1 taken along line 4-4 in FIG. 1 according to one embodiment presented herein, which illustrates the diluent baffle 112. The diluent baffle 112 is annular and forms around the inner wall 110, while leaving a gap between the outer edge of the diluent baffle 112 and the housing 101. The micro-ingredients flow through the corresponding micro-ingredient conduits 114, not interacting with the diluent or macro-ingredient sweetener until mixing around and/or below the nozzle exit 103. The diluent conduit 124 stops above the diluent baffle 112, depositing the diluent onto the diluent baffle 112. As the diluent impacts the diluent baffle 109, some of the diluent may flow over the edge of the diluent baffle 112, while the rest of the diluent may flow in a substantially annular path along the diluent baffle 112, mixing along the way with the macro-ingredient sweetener falling from the sweetener holes 111. The macro-ingredient sweetener and diluent may then flow over the edge of the diluent baffle 112.

Figure 5:
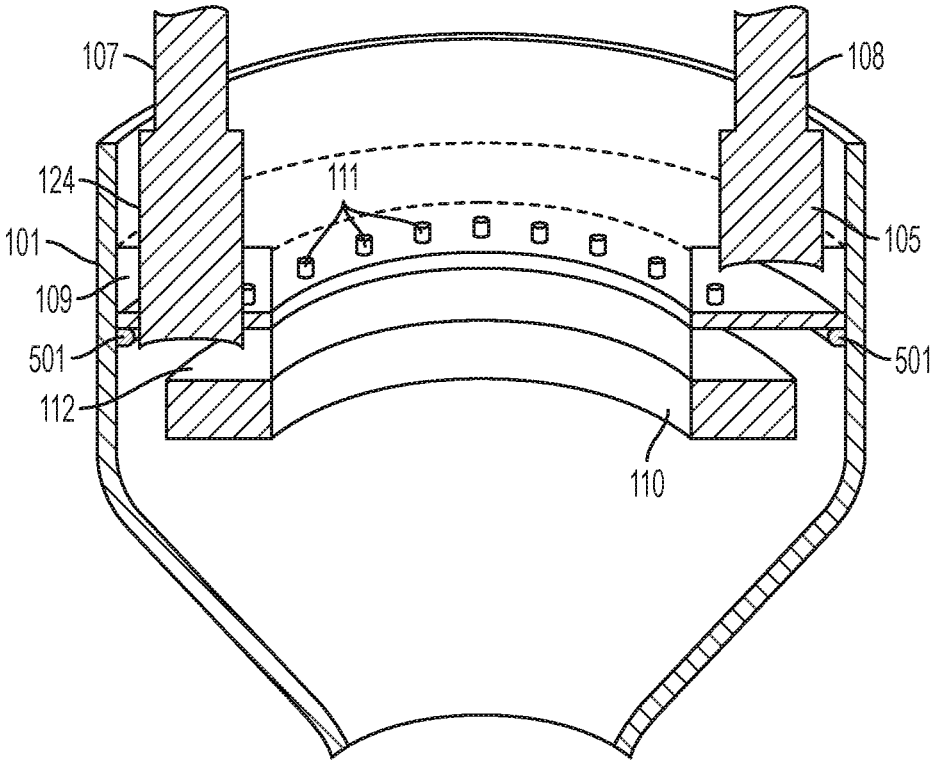
FIG. 5 is a top-front cross-sectional perspective view of the dispensing nozzle assembly according to the embodiment in FIG. 1.

FIG. 5 is a cross-sectional top-front perspective view of the embodiment in FIG. 1 according to one embodiment presented herein, with the micro-ingredient conduit system 117 removed and the inner wall 110 and the sweetener channel 109 appearing transparent. The sweetener channel 109 may be mounted within the housing 101 by resting on a nozzle-manifold support-ring 501, which extends around the inside of the housing 101. Alternative ways to mount the sweetener channel 109 include, but are not limited to, the sweetener channel 109 containing threads on an outer wall, which may screw into similar threads in the housing 101; the bottom of the sweetener channel 109 containing slots, which lock into corresponding supports in the housing; or a number of other ways which a person having ordinary skill in the art will recognize. The sweetener holes 111 are situated around the bottom surface of the sweetener channel 109, allowing the macro-ingredient sweetener to pass through and travel towards the diluent baffle 112. The diluent conduit 124 and the sweetener conduit 125 may be cylindrical and may be permanently fixed in the sweetener channel 109 or, alternatively, may be mounted in a removable fashion, as recognized by a person having ordinary skill in the art. The sweetener channel 109 may be permanently fixed to the inner wall 110 or, alternatively, may have a separate inner wall and be rested or mounted on top of, or on the side of the inner wall 110 via gravity, threads, slots, or in another manner recognized by a person having ordinary skill in the art. The diluent baffle 112 may be permanently fixed to the inner wall 110 or, alternatively, may be mounted on the bottom of, or on the side of the inner wall 110 via gravity, threads, slots, or in another manner recognized by a person having ordinary skill in the art.

Figure 6:
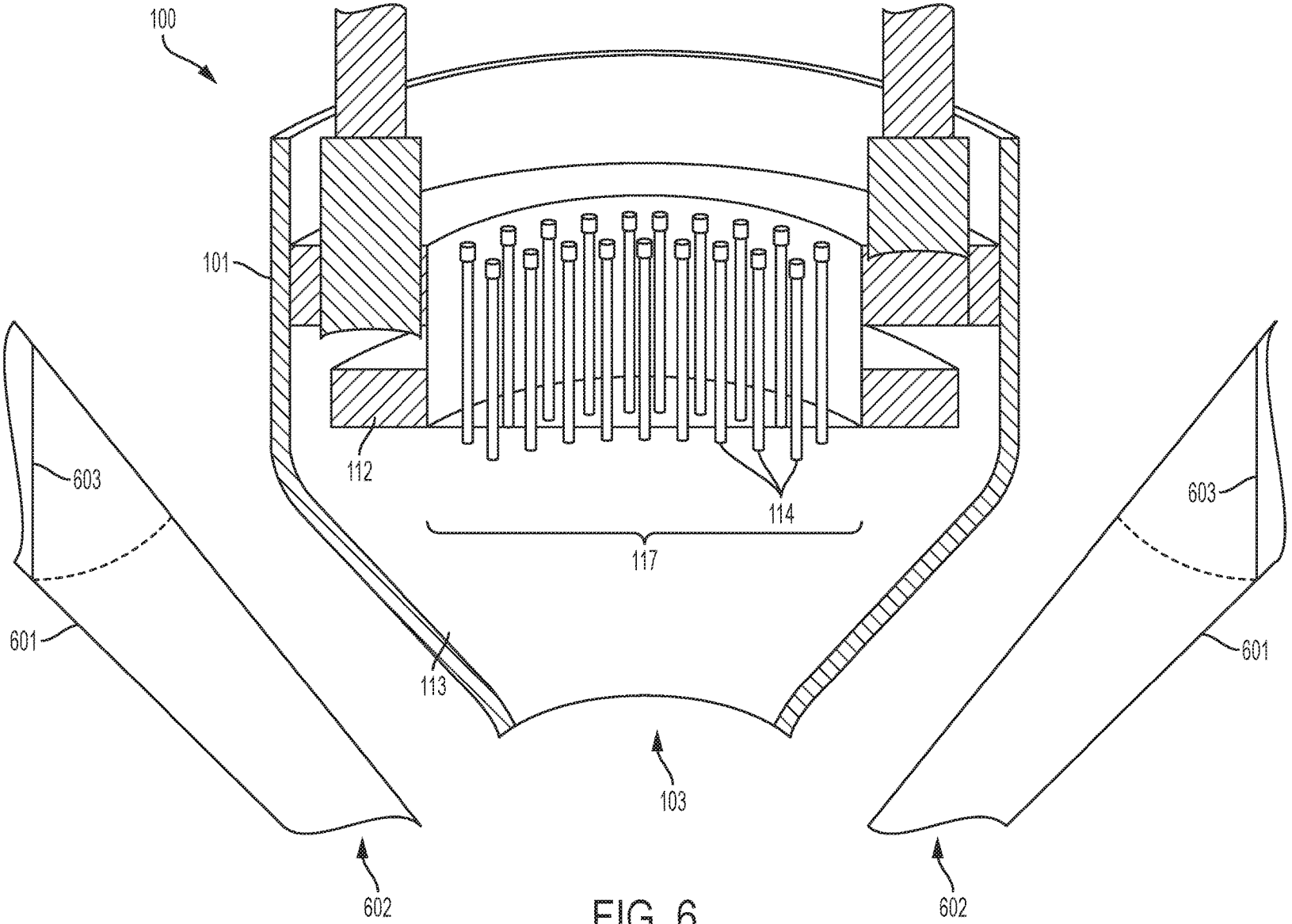
FIG. 6 is a top-front cross-sectional perspective view of the dispensing nozzle assembly according to the embodiment in FIG. 1.

FIG. 6 is a cross-sectional top-front perspective view of the embodiment in FIG. 1 according to one embodiment presented herein, with the micro-ingredient conduit system 117 appearing transparent. The micro-ingredient conduit system 117 may be permanently fixed to the inner wall 110 or, alternatively, may be mounted on top of, or on the side of the inner wall 110 via gravity, threads, slots, or in another manner recognized by a person having ordinary skill in the art. Mounting the nozzle manifold 102 components in a removable fashion may create a more modular nozzle 100, facilitating the repair or replacement of components.

When a beverage calls for one or more micro-ingredients, each micro-ingredient travels through a corresponding micro-ingredient conduit 114 and falls towards the nozzle exit 103. The diluent or diluent-macro-ingredient-sweetener mixture falls over the edge of the diluent baffle 112 and flows down the inside of the housing 101 and the funnel 113 toward the nozzle exit 103 in a substantially laminar flow pattern. The flow of the fluid down the funnel 113 creates a mixing action at the nozzle exit 103, where all of the ingredients mix, including the diluent, macro-ingredient sweetener, and micro-ingredients, before and/or after exiting the nozzle 100. The substantially annular flow path at the diluent baffle 112 may translate into a spiral-shaped flow path around the funnel 113, which may lead to better mixing about the nozzle exit 103.

For example, a beverage may include one or more macro-ingredient sweeteners. As another example, a beverage may also include one or more a micro-ingredient sweeteners. As another example, a beverage may include both one or more macro-ingredient sweeteners and one or more micro-ingredient sweeteners.

To reduce cross-contamination of ingredients, the dispensing nozzle 100 may utilize a flush cycle, which may include a diluent running through the nozzle 100 before, during, and/or after the dispensing of each beverage to wash away any residual ingredients from the diluent baffle 112, housing 101, funnel 113, or nozzle exit 103. The dispensing nozzle 100 may also utilize a pre-rinse, which may include a diluent running through the nozzle 100 before any macro-ingredient sweetener is dispensed. The pre-rinse may facilitate the flow of the macro-ingredient sweetener through the dispensing nozzle 100.

Exterior to the nozzle 100 may be an ice dispenser 601. The ice dispenser 601 may be displaced away from the nozzle 100, having a stop lever 603, which may prevent the flow of ice when engaged. In one or more embodiments, ice may be dispensed simultaneously with a beverage.

Figure 7:
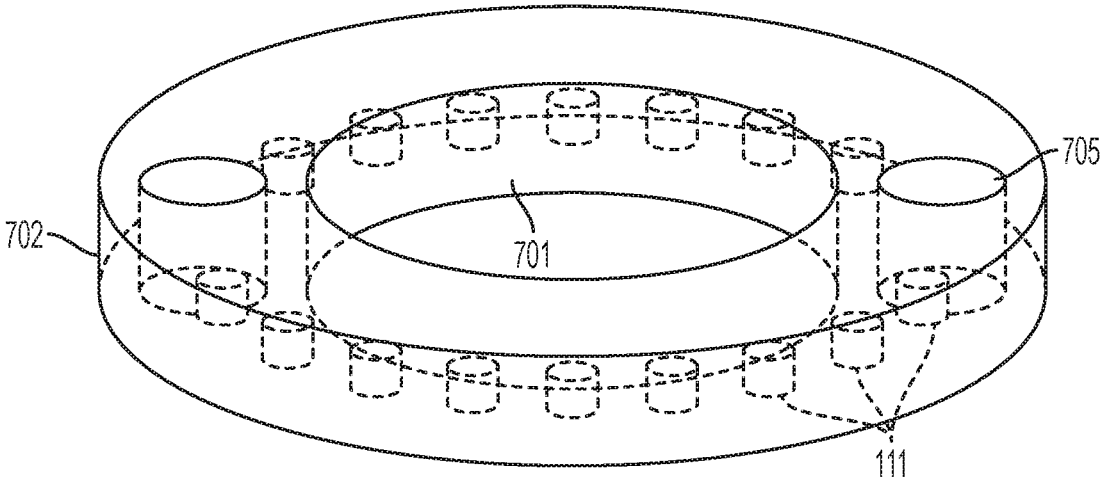
FIG. 7 is a top-front perspective view of the sweetener channel according to the embodiment in FIG. 1.

FIG. 7 is a top-front perspective view of the sweetener channel 109 according to the embodiment in FIG. 1, with the sweetener channel 109 appearing transparent. The sweetener channel 109 may be annular and may have an interior ring 701 and an exterior ring 702, which may seal the sides of the channel. The inner wall 110, as displayed in FIG. 1 may serve as the interior ring 701, or the sweetener channel 109 may have a separate wall which serves as the interior ring 701. The housing 101 may serve as the exterior ring 702, or the sweetener channel 109 may have a separate wall which serves as the exterior ring 702. Having separate walls serve as the interior and exterior rings 701 and 702 may make the nozzle 100, as displayed in FIG. 1, more modular, allowing for easier disassembly and repair or replacement of the sweetener channel 109. However, having separate walls serve as the interior and exterior rings 701 and 702 may require a way to mount the sweetener channel 109 to the housing 101, as displayed in FIG. 1, and may require a way to mount the sweetener channel 109 to the inner wall 110, as displayed in FIG. 1, as previously explained.

The inside of the sweetener channel 109 may be hollow, allowing the macro-ingredient sweetener to enter from sweetener-port orifice 705 and move in an annular path through the sweetener channel 109. Sweetener holes 111 may be distributed around the bottom surface of the sweetener channel 109, allowing macro-ingredient sweetener to exit the sweetener channel 109 vertically downward. Eighteen sweetener holes 111 are depicted in FIG. 7, but a person having ordinary skill in the art may add or subtract sweetener holes 111 as needed, as well as alter the diameter of the sweetener holes 111 to achieve the correct flow rate of macro-ingredient sweetener. Above the sweetener holes 111 may be a valve membrane 115, as depicted in FIGS. 1 and 3, which may prevent the flow of macro-ingredient sweetener through the sweetener holes 111 unless the sweetener channel 109 is pressurized.

Figure 8:
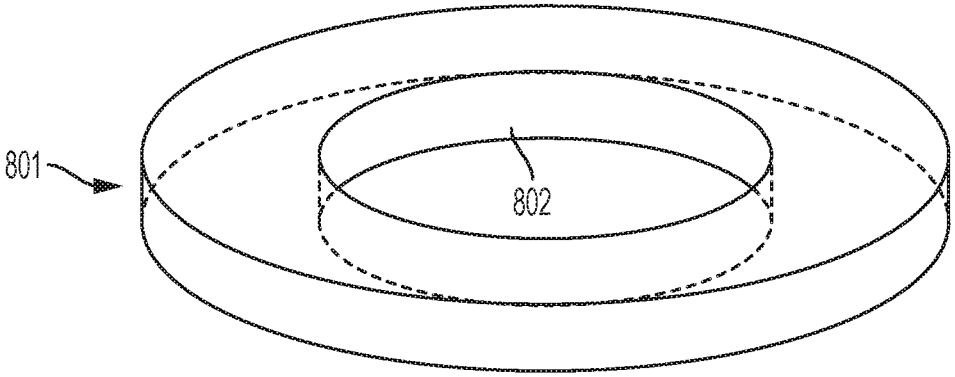
FIG. 8 is a top-front perspective view of the diluent baffle according to the embodiment in FIG. 1.

FIG. 8 is a top-front perspective view of the diluent baffle 112 according to the embodiment in FIG. 1. The diluent baffle 112 may be annular and may have an interior surface 802. The interior surface 802 may be permanently attached to the inner wall 110, or may be mounted in a manner making the diluent baffle 112 removable. Having a removable diluent baffle 112 may make the nozzle 100, as displayed in FIG. 1, more modular, allowing for easier disassembly and repair replacement of the diluent baffle 109.

The diluent baffle 112 may contain a baffle lip 801 at the outer edge. A person having ordinary skill in the art will recognize that the baffle lip 801 may be altered to change the surface tension, forcing more or less diluent to flow in an annular path along the diluent baffle 112, as needed, before flowing over the edge of the diluent baffle 112.

Figure 9:
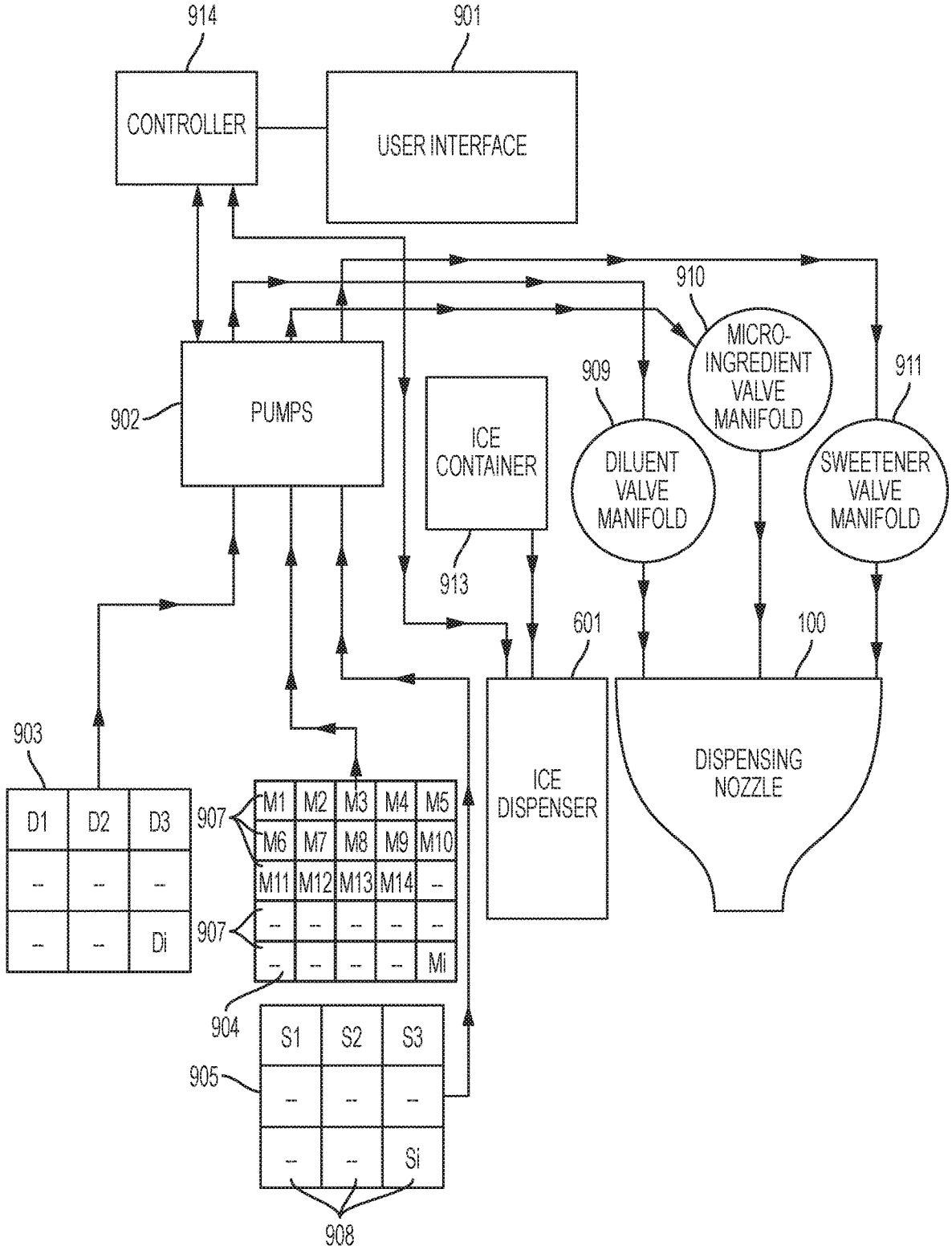
FIG. 9 is a schematic of a beverage dispensing system, according to one embodiment presented herein.

FIG. 9 is a schematic of a beverage dispensing system 900 according to one embodiment. The beverage dispensing system 900 may have a user interface 901 configured to receive a beverage selection. The user interface 901 may be in communication with a controller 914, which may be programmed to control the beverage dispensing system 900. The controller 914, may include a controller, a microcontroller, or any other component which a person having ordinary skill in the art would recognize as capable of controlling a beverage dispensing system 900. The controller 914 interfaces with one or more pumps 902, which control the flow of the ingredients.

Upon a command from the controller 914, the one or more pumps 902 may initiate the flow of one or more diluents 903, one or more micro-ingredients 904, and/or one or more macro-ingredient sweeteners 905 that correspond to the ingredients needed to dispense the received beverage selection on the user interface 901. The diluents 903 may come from an external source (not pictured), or may be contained in separate cartridges 906. The micro-ingredients 904 may come from an external source (not pictured), or may be contained in separate cartridges 907. The macro-ingredient sweeteners 905 may come from an external source (not pictured), or may be contained in separate cartridges 908. The number of cartridges 906, 907, and 908 may correspond to the number of ingredients of each diluent 903, micro-ingredient 904, and macro-ingredient sweetener 905 needed for each available beverage in the beverage dispensing system 900. The cartridges 906, 907, and 908 may be modular, designed for easy replacement when necessary.

The controller may be in communication with a diluent valve manifold 909, a micro-ingredient valve manifold 910, and a sweetener valve manifold 911. The diluents 903, micro-ingredients 904, and macro-ingredient sweeteners 905 may be delivered to the corresponding diluent valve manifold 909, micro-ingredient valve manifold 910, and sweetener valve manifold 911, which may deliver the corresponding ingredients to the dispensing nozzle 100. The dispensing nozzle 100 may operate in a manner previously described.

The beverage dispensing system 900 may also contain an ice dispenser 601, which may operate in a manner previously described. The ice dispenser 601 may communicate with the controller 901. Upon a command from the user interface 901, the controller 914 may command the ice dispenser 601 to dispense ice from an ice container 913.

It should be appreciated that the logical operations described above with reference to FIGS. 1-9 may be implemented (1) as a sequence of computer implemented acts or program modules running on a computing system and/or (2) as interconnected machine logic circuits or circuit modules within the computing system. The implementation is a matter of choice dependent on the performance and other requirements of the computing system. Accordingly, the logical operations described herein are referred to variously as states operations, structural devices, acts, or modules. These operations, structural devices, acts and modules may be implemented in software, in firmware, in special purpose digital logic, and any combination thereof. It should also be appreciated that more or fewer operations may be performed than shown in the figures and described herein. These operations may also be performed in a different order than those described herein.

CONCLUSION

Although the subject matter has been described in language specific to structural features and/or methodological acts, it is to be understood that the subject matter defined in the appended claims is not necessarily limited to the specific features or acts described. Rather, the specific features and steps are disclosed as example forms of implementing the claims.

All of the methods and processes described above may be embodied in, and fully or partially automated via, software code modules executed by one or more general purpose computers or processors. The code modules may be stored in any type of computer-readable storage medium or other computer storage device. Some or all of the methods may additionally or alternatively be embodied in specialized computer hardware.

Conditional language such as, among others, "can," "could," or "may," unless specifically stated otherwise, means that certain examples include, while other examples do not include, certain features, elements and/or steps. Thus, such conditional language does not imply that certain features, elements and/or steps are in any way required for one or more examples or that one or more examples necessarily include logic for deciding, with or without user input or prompting, whether certain features, elements and/or steps are included or are to be performed in any particular example.

Conjunctive language such as the phrases "and/or" and "at least one of X, Y or Z," unless specifically stated otherwise, mean that an item, term, etc. may be either X, Y, or Z, or a combination thereof.

Any routine descriptions, elements or blocks in the flow diagrams described herein and/or depicted in the attached figures should be understood as potentially representing modules, segments, or portions of code that include one or more executable instructions for implementing specific logical functions or elements in the routine. Alternate implementations are included within the scope of the examples described herein in which elements or functions may be deleted, or executed out of order from that shown or discussed, including substantially synchronously or in reverse order, depending on the functionality involved as would be understood by those skilled in the art.

It should be emphasized that many variations and modifications may be made to the above-described examples, the elements of which are to be understood as being among other acceptable examples. All such modifications and variations are intended to be included herein within the scope of this disclosure and protected by the following claims.

What is claimed is:

1. A dispensing nozzle comprising:

a nozzle manifold comprising at least a first conduit configured to receive one or more diluents, at least a second conduit configured to receive one or more macro-ingredient sweeteners, and a plurality of micro-ingredient conduits configured to receive a plurality of micro-ingredients;

wherein the nozzle manifold comprises a sweetener channel configured to receive the one or more macro-ingredient sweeteners, the sweetener channel containing a plurality of holes in a bottom surface allowing the one or more macro-ingredient sweeteners to pass through;

wherein the nozzle manifold comprises a diluent baffle configured to receive the one or more diluents and the one or more macro-ingredient sweeteners and allow the received diluent and the macro-ingredient sweetener to mix;

a nozzle housing, wherein a bottom portion of the nozzle housing comprises a nozzle exit;

the nozzle housing configured to receive the mixture of the one or more diluents and the one or more macro-ingredient sweeteners and allow the mixture of the one or more diluents and the one or more macro-ingredient sweeteners to flow down the nozzle housing; and the nozzle housing further configured to allow the mixture of the one or more diluents and the one or more macro-ingredient sweeteners and the received micro-ingredients to mix about the nozzle exit.

2. The dispensing nozzle of claim 1, wherein the first conduit is configured to receive at least carbonated water;

wherein the second conduit is configured to receive at least a nutritive sweetener.

3. The dispensing nozzle of claim 1, wherein the sweetener channel contains a valve membrane configured to prevent flow of the one or more macro-ingredient sweeteners unless a threshold pressure level is reached.

4. The dispensing nozzle of claim 1, wherein the second conduit contains a stop valve configured to control the flow of macro-ingredient sweetener.

5. The dispensing nozzle of claim 1, wherein the dispensing nozzle is modular.

6. The dispensing nozzle of claim 1, wherein the dispensing nozzle is further configured to receive a diluent to wash away one or more residual ingredients from the nozzle housing.

7. A beverage dispensing system, comprising:

a user interface configured to receive a beverage selection;

a controller in communication with the user interface;

a dispensing nozzle comprising:

a nozzle manifold comprising at least a first conduit configured to receive one or more diluents, at least a second conduit configured to receive one or more macro-ingredient sweeteners, and a plurality of micro-ingredient conduits configured to receive a plurality of micro-ingredients;

wherein the nozzle manifold comprises a sweetener channel configured to receive the one or more macro-ingredient sweeteners, the sweetener channel containing a plurality of holes in a bottom surface allowing the one or more macro-ingredient sweeteners to pass through;

wherein the nozzle manifold comprises a diluent baffle configured to receive the one or more diluents and the one or more macro-ingredient sweeteners and allow the received diluent and the macro-ingredient sweetener to mix;

a nozzle housing, wherein a bottom portion of the nozzle housing comprises a nozzle exit;

the nozzle housing configured to receive the mixture of the one or more diluents and the one or more macro-ingredient sweeteners and allow the mixture of the one or more diluents and the one or more macro-ingredient sweeteners to flow down the nozzle housing;

the nozzle housing further configured to allow the mixture of the one or more diluents and the one or more macro-ingredient sweeteners and the received micro-ingredients to mix about the nozzle exit; and one or more pumps in communication with the controller, wherein the one or more pumps regulate the flow of the one or more diluents, the one or more macro-ingredient sweeteners, and the plurality of micro-ingredients.

8. The beverage dispensing system of claim 7, further comprising an ice dispenser externally disposed to the dispensing nozzle.

9. The beverage dispensing system of claim 8, wherein the ice dispenser and the dispensing nozzle are configured to dispense simultaneously into a beverage container.

10. The beverage dispensing system of claim 7, wherein the first conduit is configured to receive at least carbonated water; and wherein the second conduit is configured to receive at least a nutritive sweetener.

11. The beverage dispensing system of claim 7, wherein the sweetener channel contains a valve membrane configured to prevent flow of the macro-ingredient sweetener unless a threshold pressure level is reached.

12. The beverage dispensing system of claim 7, wherein the second conduit contains a stop valve configured to control the flow of macro-ingredient sweetener.

13. The beverage dispensing system of claim 7, wherein the dispensing nozzle is modular.

14. The beverage dispensing system of claim 7, wherein the dispensing nozzle is further configured to receive a diluent to wash away one or more residual ingredients from a funnel.

* * * * *